US008434253B2

(12) United States Patent
Cain et al.

(10) Patent No.: US 8,434,253 B2
(45) Date of Patent: May 7, 2013

(54) MAGAZINE RELEASE LATCH AND TRIGGER GUARD

(76) Inventors: Randy Cain, Glendora, CA (US); Hoyt Yang, Walnut, CA (US)

( * ) Notice: Subject to any disclaimer, the term of this patent is extended or adjusted under 35 U.S.C. 154(b) by 65 days.

(21) Appl. No.: 13/065,689

(22) Filed: Mar. 28, 2011

(65) Prior Publication Data

US 2011/0232148 A1 Sep. 29, 2011

Related U.S. Application Data

(60) Provisional application No. 61/318,659, filed on Mar. 29, 2010.

(51) Int. Cl.
*F41A 9/61* (2006.01)

(52) U.S. Cl.
USPC ..... 42/6; 42/49.01

(58) Field of Classification Search ..... 42/6, 49.01, 42/50

See application file for complete search history.

(56) References Cited

U.S. PATENT DOCUMENTS

| | | | | |
|---|---|---|---|---|
| 2,736,977 | A * | 3/1956 | Harvey | 42/50 |
| 3,088,378 | A * | 5/1963 | Boudreau | 89/161 |
| 4,237,638 | A * | 12/1980 | Trexler | 42/6 |
| 4,450,641 | A * | 5/1984 | Bullis et al. | 42/6 |
| 4,815,226 | A * | 3/1989 | Ruger | 42/6 |
| 5,899,013 | A * | 5/1999 | Hauser et al. | 42/6 |
| 7,596,900 | B2 * | 10/2009 | Robinson et al. | 42/7 |

* cited by examiner

*Primary Examiner* — Samir Abdosh
(74) *Attorney, Agent, or Firm* — Robert M. Sperry

(57) ABSTRACT

An improved magazine release latch and trigger guard combination which is operable by the shooter's trigger finger while holding the rifle stock in the same hand.

7 Claims, 4 Drawing Sheets

MAGAZINE RELEASE LATCH AND TRIGGER GUARD

RELATED CASES

This invention is described in our provisional patent application Ser. No. 61/318,659, filed Mar. 29, 2010 and now abandoned.

FIELD OF INVENTION

This invention relates to firearms and is particularly directed to improved magazine releases.

BACKGROUND

On prior art firearms, the magazine release latch is a long lever located in front of and below the trigger guard. However, this places the magazine release latch too far forward for the shooter to actuate with their right hand, while holding the stock in their right hand. Consequently, in order to depress the magazine release latch, it is necessary for the shooter to hold the replacement magazine in their left hand and to use their thumb to pivot the lever to eject the old magazine. This action is awkward and inconvenient for the shooter. Thus, none of the prior art magazine release latches have been entirely satisfactory.

BRIEF SUMMARY AND OBJECTS OF INVENTION

These disadvantages of the prior art are overcome with the present invention and an improved magazine release latch is provided which is quickly and easily operable by either hand while gripping the stock with the same hand.

These advantages of the present invention are preferably attained by providing an improved magazine release latch and trigger guard combination which is operable by the shooter's trigger finger while holding the stock in the same hand and which can be substituted for a conventional latch and release mechanism.

Accordingly it is an object of the present invention to provide an improved magazine release latch.

Another object of the present invention is to provide an improved magazine release latch and trigger guard combination.

A further object of the present invention is to provide an improved magazine release latch and trigger guard combination which is quickly and easily operable.

Another object of the present invention is to provide an improved magazine release latch and trigger guard combination which is quickly and easily operable by either hand.

An additional object of the present invention is to provide an improved magazine release latch and trigger guard combination which is quickly and easily operable by either hand while holding the stock with the same hand.

A further object of the present invention is to provide and improved magazine release latch and trigger guard which can be substituted for a conventional latch and release mechanism.

A specific object of the present invention is to provide an improved magazine release latch and trigger guard combination which is operable by the shooter's trigger finger while holding the stock in the same hand.

These and other objects and features of the present invention will be apparent from the following detailed description, taken with reference to the figures of the accompanying drawing.

DETAILED DESCRIPTION OF THE INVENTION

Figure 1:
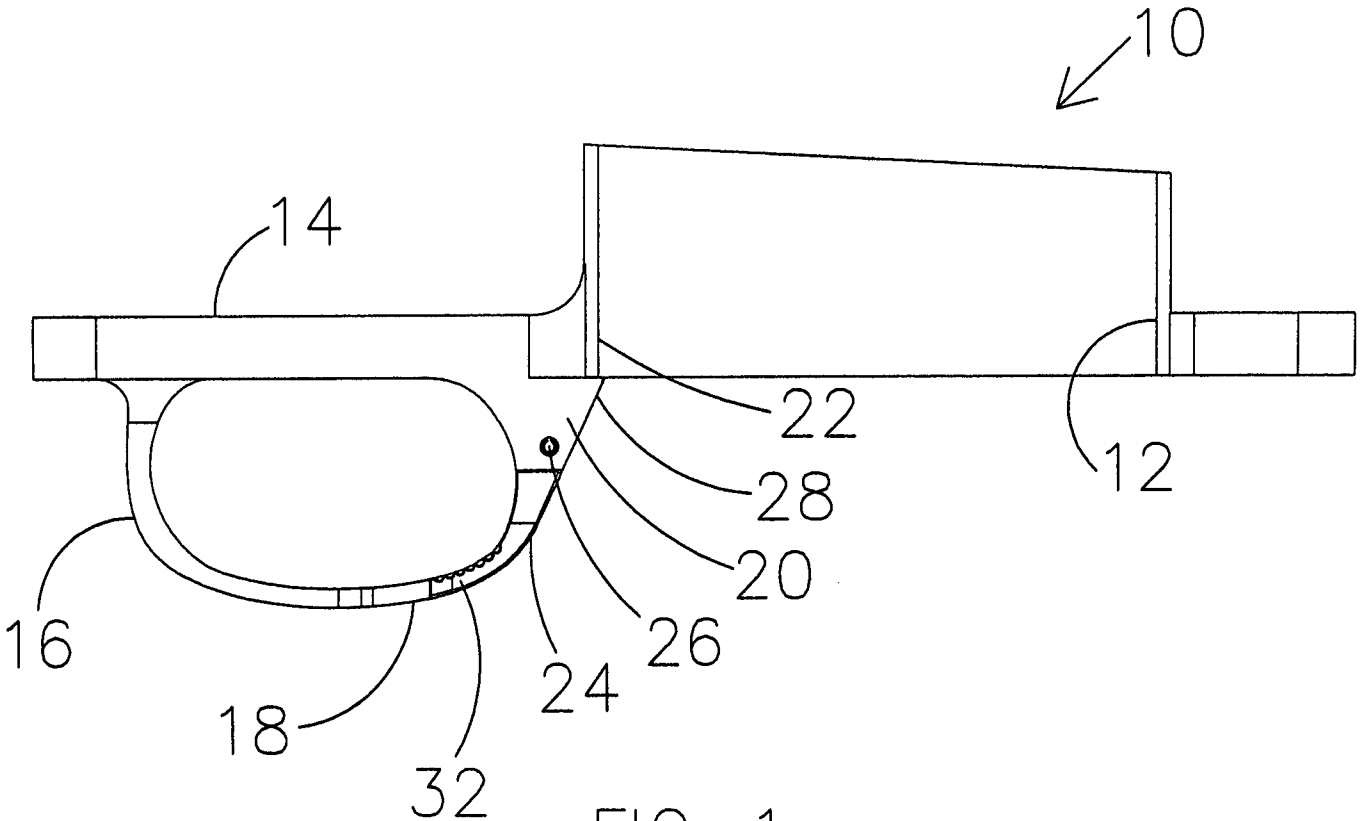
FIG. 1 is a side view of a magazine release latch and trigger guard embodying the present invention, showing the magazine release latch in the "Latched" position.
Figure 2:
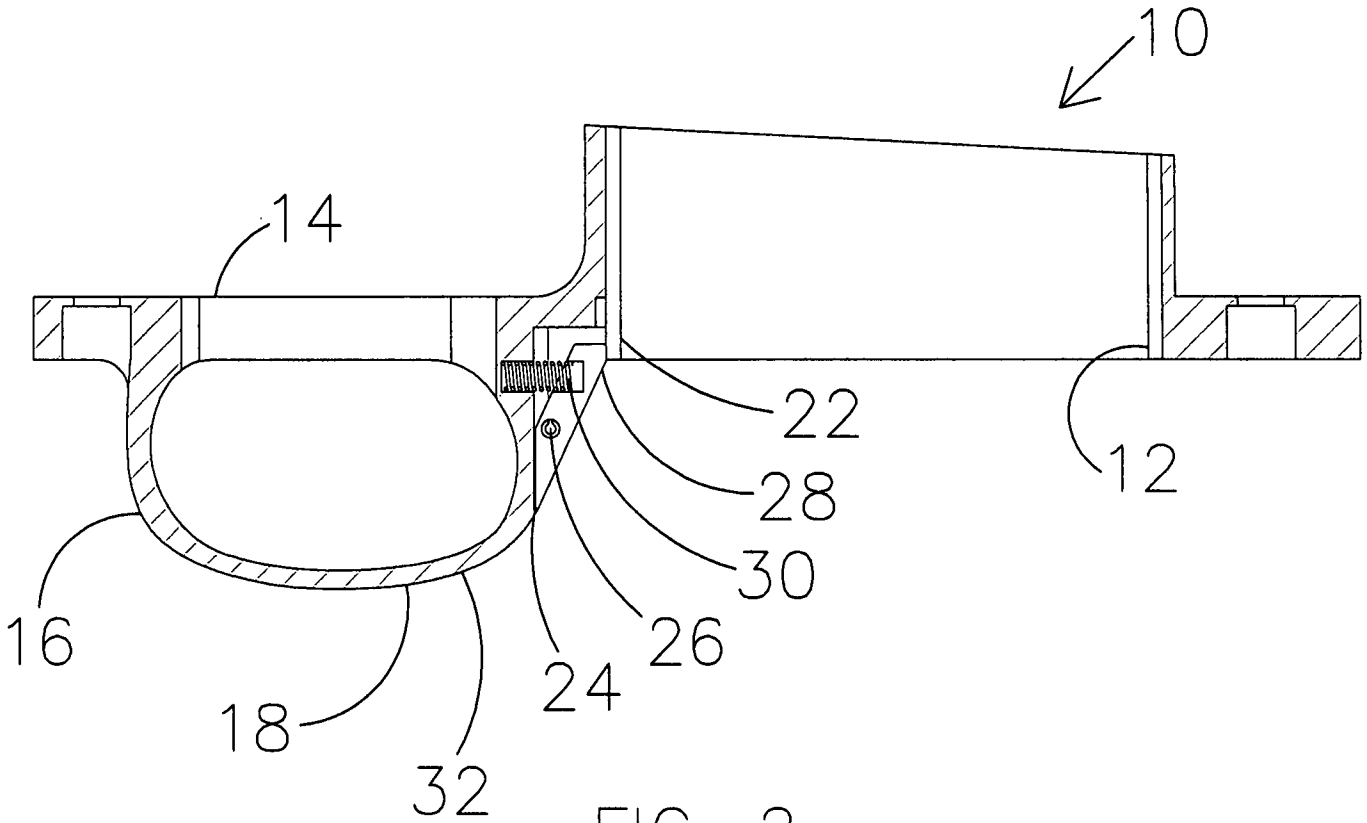
FIG. 2 is a view similar to that of FIG. 1, with parts broken away for clarity.
Figure 3:
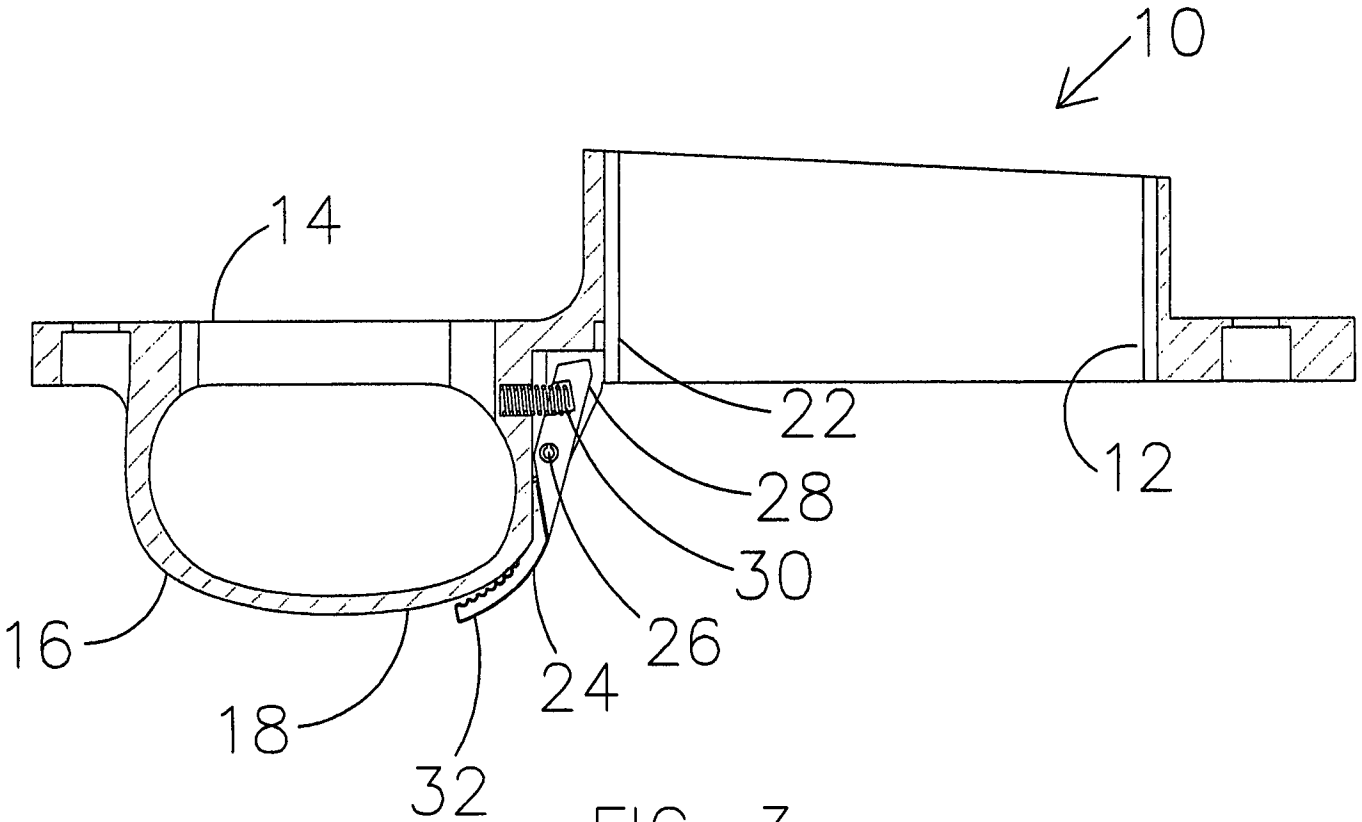
FIG. 3 is a view similar to that of FIG. 2 showing the magazine release latch in the "Open" position.

In that form of the present invention chosen for purposes of illustration, FIG. 1 shows A magazine chute and trigger guard assembly embodying the present invention, indicated generally at 10, having a magazine chute 12 with a trigger guard section 14 projecting rearwardly therefrom. As shown, the trigger guard 16 extends downwardly and forwardly from the rear end of the trigger guard section 14 to a point 18 forward of the end of the trigger, not shown. A pair of parallel projections 20 extend downwardly adjacent the rear end 22 of the magazine chute 12 and a magazine release latch 24 is pivotally mounted between the projections 20 by suitable means, such as pin 26. As best seen in FIGS. 2 and 3, the magazine release latch 24 is formed with a latch portion 28 which is normally urged by spring 30 to project slightly forwardly of end 22 of the magazine chute 12. Also, the magazine release latch 24 has a pair of rearwardly extending portions 32 which follows substantially the same line as the trigger guard 16 when the magazine release latch 24 is in the "Latch" position. When portion 32 of the magazine release latch 24 is pressed downwardly, it pivots about pin 26, causing the latch portion 28 to retract rearwardly, against the action of spring 30, out of the magazine chute 12 to allow a magazine contained in the magazine chute 12 to be ejected and replaced.

Figure 4:
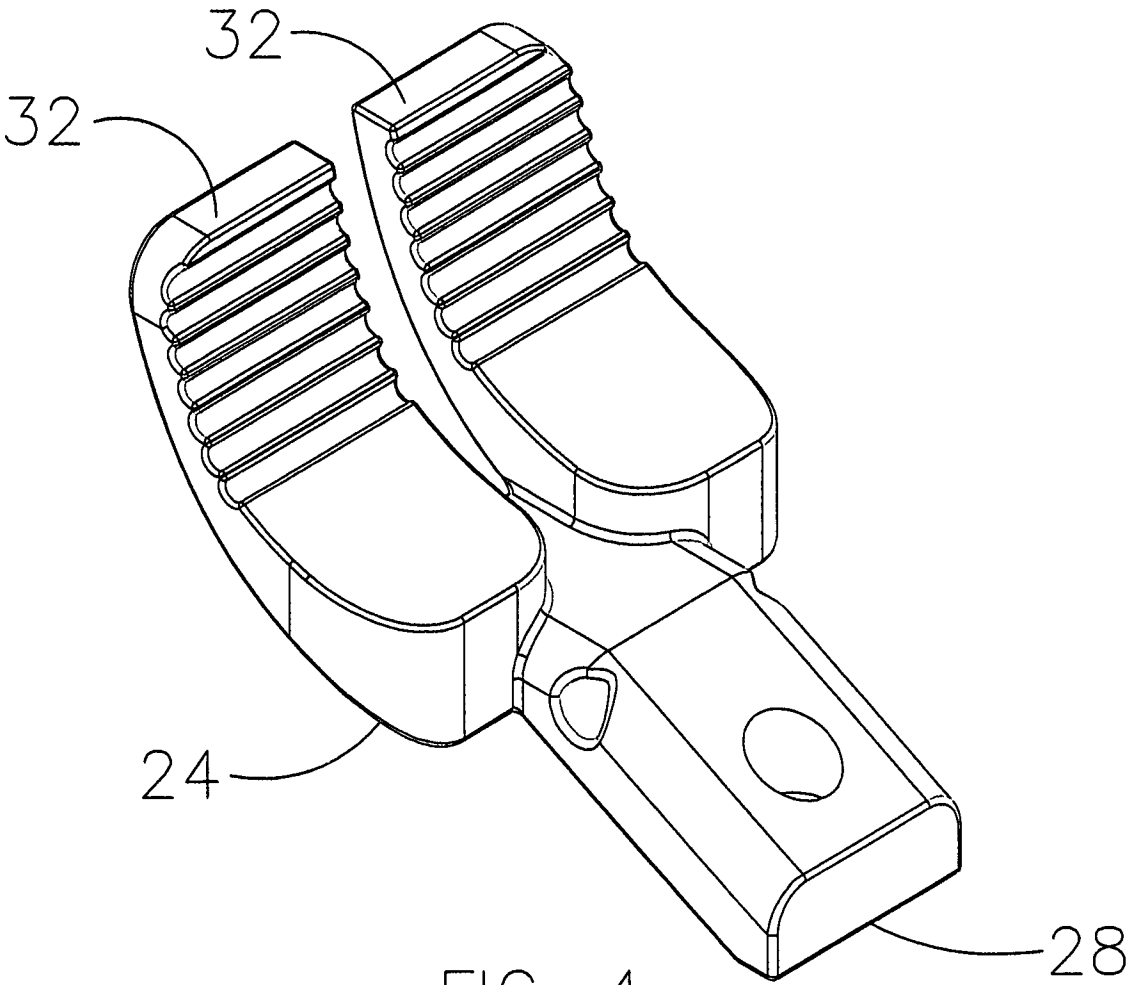
FIG. 4 is an isometric view of the magazine release latch.

FIG. 4 is an isometric view of the magazine release latch 24 of FIGS. 1-3. As seen in FIG. 4, the release portions 32 of the magazine release latch 24 extend rearwardly on either side of the trigger guard 16 and, engage opposite sides of end 18 of the trigger guard 16 when the magazine release latch 24 is in the "Latch".

In use, a magazine, not shown, can be inserted into the magazine chute 12 by forcing it upward, thereby forcing the latch portion 28 of the magazine release latch 24 rearwardly. When the magazine is fully inserted into the magazine chute 12, spring 30 will force the latch portion 28 of the magazine release latch 24 to move forwardly. Thus, retaining the magazine within the magazine chute 12. When it is desired to remove the magazine, portion 32 of the magazine release latch 24 is pressed downward, causing the latch portion 28 to retract rearwardly, against the action of spring 30, out of the magazine chute 12 to allow a magazine contained in the magazine chute 12 to be ejected and replaced. When desired, a new magazine can be inserted into the magazine chute 12, as described above. It will be apparent that the magazine release latch 24 can be actuated by the trigger finger of the shooter without necessitating release of the shooter's grip on the stock of the rifle. Also, the parallel portions 32 of the magazine release latch 24 allow the magazine release latch 24 to be actuated easily by both right- and left-handed shooters.

Obviously, numerous variations and modifications can be made without departing from the spirit of the present invention. Therefore, it should be clearly understood that the forms of the present invention described above and shown in the figures of the accompanying drawing are illustrative only and are not intended to limit the scope of the present invention.

What is claimed is:

1. A magazine chute for a firearm comprising:

a magazine chute having a rear end, a trigger guard portion projecting rearwardly from said magazine chute having a trigger guard extending downwardly and forwardly therefrom, a magazine release latch mounted adjacent said magazine chute having a retractable latch portion projecting forwardly of the rear end of said magazine chute and a pair of latch release members projecting downwardly from said latch portion on opposite sides of said trigger guard;

said latch release members comprising a pair of parallel projections extending downward adjacent the rear end of said magazine chute, said magazine release latch being pivotally mounted between said projections.

2. The magazine chute of claim 1 wherein:

said magazine release latch being pivotally mounted.

3. The magazine chute of claim 1 further comprising:

said magazine latch having at least one rearwardly projecting portion extending to a point adjacent said trigger guard.

4. The magazine chute of claim 1 wherein:

said magazine release latch is mounted adjacent the rear end of said magazine chute.

5. The magazine chute of claim 1 further comprising:

said magazine release latch having a pair of parallel rearwardly projecting portions engaging said trigger guard on opposite sides.

6. The magazine chute of claim 1 further comprising:

resilient means normally urging the latch portion of said magazine release latch to project forwardly of said rear end of said magazine chute.

7. The magazine latch of claim 1 wherein:

said rearwardly projecting portion follows substantially the same line as the trigger guard.

* * * * *

UNITED STATES PATENT AND TRADEMARK OFFICE

CERTIFICATE OF CORRECTION

PATENT NO. : 8,434,253 B2
APPLICATION NO. : 13/065689
DATED : May 7, 2013
INVENTOR(S) : Randy Cain et al.

It is certified that error appears in the above-identified patent and that said Letters Patent is hereby corrected as shown below:

On the Title Page

Change Item (76) to Item (75)

Add

Item (73) Assignee: George Huang
c/o Battle Arms Development, Inc.
Box 92742
Henderson, NV 89009

Signed and Sealed this
Thirteenth Day of May, 2014

Michelle K. Lee

Michelle K. Lee
*Deputy Director of the United States Patent and Trademark Office*